United States Patent [19]

Masson

[11] Patent Number: 4,852,166

[45] Date of Patent: Jul. 25, 1989

[54] ANALOGUE SCRAMBLING SYSTEM WITH DYNAMIC BAND PERMUTATION

[75] Inventor: Jacques L. R. Masson, La Celle Saint Cloud, France

[73] Assignee: Telecommunications Radioelectriques et Telephoniques T.R.T., Paris, France

[21] Appl. No.: 115,477

[22] Filed: Oct. 30, 1987

[30] Foreign Application Priority Data

Oct. 31, 1986 [FR] France ..... 86 15209

[51] Int. Cl.[4] ..... H04K 1/04; H04K 1/06; H04K 1/10; H04K 9/02

[52] U.S. Cl. ..... 380/36; 380/33; 380/40; 380/41; 380/43; 380/46; 380/48

[58] Field of Search ..... 380/9, 33, 36, 38–44, 380/46, 48, 49

[56] References Cited

U.S. PATENT DOCUMENTS

| | | | |
|---|---|---|---|
| 3,991,271 | 11/1976 | Branscome et al. | 380/38 |
| 4,068,094 | 1/1978 | Schmid et al. | 380/39 |
| 4,188,506 | 2/1980 | Schmid et al. | 380/39 |
| 4,221,931 | 9/1980 | Seiler | 380/36 |
| 4,525,844 | 6/1985 | Scheuermann | 380/38 |
| 4,551,580 | 11/1985 | Cox et al. | 380/38 |
| 4,663,500 | 5/1987 | Okamoto et al. | 380/47 |
| 4,747,137 | 5/1988 | Matsunaga | 380/6 |

*Primary Examiner*—Stephen C. Buczinski
*Attorney, Agent, or Firm*—Emmanuel J. Lobato

[57] ABSTRACT

An analogue scrambling system with dynamic band permutation in which the speech signal is filtered (1), sampled (2) at the rate $f_e$, digitized (3), transformed by means of an analysis filter bank (4) into N sub-band signals sampled at $f_e/N$ and transferred in a permuted order to a synthesis filter bank (13) accomplishing the calculations of the scrambled signal sampled at the rate $f_e$. A set of permutations is protected in a memory (8) and a scrambling with dynamic permutation in time is obtained by changing the read addresses of the memory. The scrambled signal reconverted into an analogue signal (14, 15) is transmitted through an analogue channel to an unscrambler where it is preprocessed so that the synchronizing and equalizing functions are accomplished and where the accomplished processes are identical with those accomplished in the scrambler, the difference being that the permuted order of the N sub-band signals is restored.

6 Claims, 7 Drawing Sheets

ANALOGUE SCRAMBLING SYSTEM WITH DYNAMIC BAND PERMUTATION

BACKGROUND OF THE INVENTION

The invention relates to an analogue scrambling system in which the processing of the speech signal accomplished in digital signal processors comprises the following operations: filtering, sampling and digitizing in an analogue-to-digital converter, processing by the analysis filter bank transforming the signal sampled at the rate $f_e$ into N sub-band signals sampled at $f_e/N$ and transferred in a permuted order to the synthesis filter bank which carries out the calculations of the scrambled signal sampled at the rate $f_e$ to which is digitally added the synchronizing wave $\sin(2\pi nTf_e/4)$, wherein T is the duration of the sampling cycle, while the scrambled digital signal obtained thus is converted into an analogue signal, filtered and transmitted through an analogue channel to the unscrambler where a preprocessor effects the synchronizing of the sampling, the compensation of the said synchronizing wave and the equalizing of the scrambled signal and where the processes that have been accomplished are identical with those accomplished at the scrambler but for the fact that the said permuted order of the N sub-band signals is reversed.

Such a system is utilized for ensuring the confidentiality of communication on a radio channel. The scrambling systems can generally be subdivided into two large families: the digital scrambling systems and the analogue scrambling systems.

The former systems do not require a digitizing and encoding of the speech signal, as the resulting binary output is encrypted by means of a pseudo-random sequence.

The degree of security obtained is potentially the highest possible, that is to say that the message cannot be decoded without knowing the key. The problem we are facing is the transmission of the signal on a standard radio channel of 3 kHz pass-band. After all, such a transmission can only take place with the aid of modems operating at 2400 or 4800 bits/s requiring the encoding of the speech signal to work at these outputs for which at best only the intelligibility of the message can be ensured. In addition, such systems of which the implementation is rather complex, can only be suitable for use in networks or connections whose subscribers are special operators (army, police, . . . ) who can accept to converse with a signal quality which is strongly degraded.

The analogue scrambling systems are distinguished from the known systems in that the waveform of the transmitted signal directly originates in the transformations of the waveform of the original speech signal. The transformations can be effected in the time domain, the frequency domain or in the two simultaneously according to the degree of confidentiality wanted. However, it should be observed that absolute security cannot be attained with this type of systems. On the other hand, they have the advantage that they can be realized in a simpler manner and offer a quality of the restored signal which is better than in the digital systems.

Historically, the first analogue scramblers were based on spectral transformations of the invention type, displacement or band permutation type. By utilizing analogue techniques, the realized scrambling showed drawbacks of which the main ones were a relatively high residual intelligibility as well as a robustness at very moderate codebreaking. For example, the band permutation technique was limited to 5 sub-bands which did not permit effective scrambling of the signal. With the appearance of memories and microprocessors, the techniques using temporary transformation have come into existence. They are based on the principle of signal block permutation of 10 to 20 ms. Thus, the distribution of the signal strength as a function of time differs from that of the original speech signal, whereas this distribution is the same in the spectral scramblers. On the other hand, the waveform of the phonemes permuted in time remains unchanged. This constitutes impairment to the direct locking of the scrambled signal with a view to restoring the order of the segments of the permuted speech signal. In addition, for ensuring the lowest possible residual intelligibility, the delays used can become very important (several hundred ms), as they can give rise to a constraint in the communication.

Based on the two techniques described before, relatively effective scramblers can be designed by cascading the temporary and spectral transformations. Yet, with the appearance of the digital signal processors very effective scrambling techniques can be designed which are in fact based on the concepts of the first scramblers and, more specifically, on frequency band permutation. By using digital techniques it is possible to do away with the problems of drift affecting the modulators, demodulators and filters used in an analogue system. Thus, it can be considered to divide a signal into a large number of frequency band signals, thereby improving the quality of the scrambling. Furthermore, the fact that quadrature mirror filters (QMF) banks can almost perfectly restore the original signal, allows to consider a very effective spectral scrambling system.

We now discuss the state of the art as regards the analogue scrambling systems with digital processing utilizing spectral permutation and of which the processing takes place in a digital form. They can be subdivided into three types:

systems coefficient permutation using the Discrete Fourier Transform, systems of band permutation using filter banks which do not ensure a perfect restoration of the band, systems of band permutation using filter banks denoted QMF or pseudo-QMF.

The systems of the first type have the characteristic feature that this signal is not modified at all when, without affecting the permutation, a transform is followed by an inverse transform. As a matter of fact, it is known that $DFT^{-1}(DFT)=\text{Identity}$. Nevertheless, the filter bank realized as such is of a very poor quality in that on the one hand the filtering function is of the type sinx/x, and on the other hand, the recoveries between the filters are very important. Thus, the verification of the encrypted signal band is not very easy and, in addition, the residual intelligibility of the encrypted message suffers from the "softness" of the filters.

These problems have been resolved with the aid of very selective filter banks which allow to dispense with synchronization. This feature may seen attractive but in fact is a drawback in that the whole transmitted message is permuted in the same way. Moreover, the filters utilized do not have the characteristic feature of having the unitary composite analysis-synthesis response and thus the quality of the reproduced signal is mediocre.

The last type of systems incorporates the advantages of the two first systems in so far as they utilize QMF or pseudo-QMF filter banks permitting a relatively selective time-frequency band division which is substantially perfect. The U.S. Pat. No. 4,551,580 discloses a scrambling system of this type and of the same kind as that described in the preamble.

In this system the QMF filter banks are utilized for dividing the signal into 5 sub-bands, with 25 consecutive samples of each sub-band constituing a block. Thus the permutation affects all 125 samples of the 5 blocks. This permutation is fixed by the choice of the key. Although the system is complex, this being fixed is a drawback.

A further characteristic features of this system is the use of an equalizer which only compensates for the channel phase while assuming that the module is unitary. This implies that the system can only be used for telephone lines and not for a mobile radio link. In addition, the principle of sending a Dirac pulse for measuring the pulselike response would be highly impracticable on a radio link.

Speech scrambling systems based on dynamic band permutation have already been obtained by analogue processing. The object of the invention is to propose a system always utilizing dynamic permutation, but which system is obtained on the basis of digital processing substantially perfectly realized in an easy way by analysis and synthesis filter banks with the aid of pseudo-QMF filters and a dividing of the signal into a large number of sub-band signals which can be permuted at a very high rate.

SUMMARY OF THE INVENTION

The analogue scrambling system in accordance with the invention is characterized in that scrambling by means of dynamic permutation in time is obtained by changing the read addresses of a memory containing a number of permutations, these addresses originating from a sequence generator whose clock rate determining the frequency of the change of the permutations can vary between 0 (fixed permutation) and $f_e/N$ (maximum rate), and the key of the system being a word loaded into the generator during the initializing sequence.

BRIEF DESCRIPTION OF THE DRAWING

The following description with respect to the annexed drawings, all this shown by way of example, will make it better understood how the invention can be realized.

Figure 8:
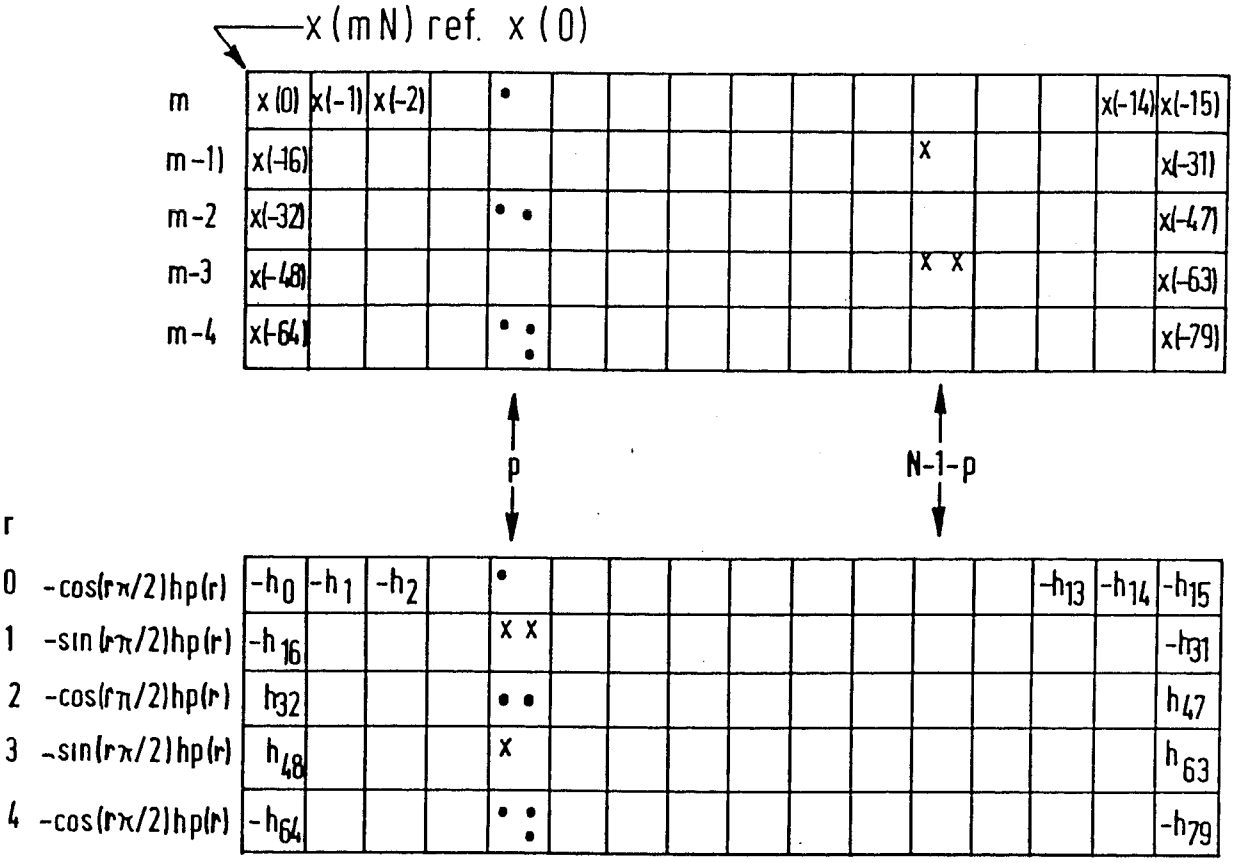
Figure 9:
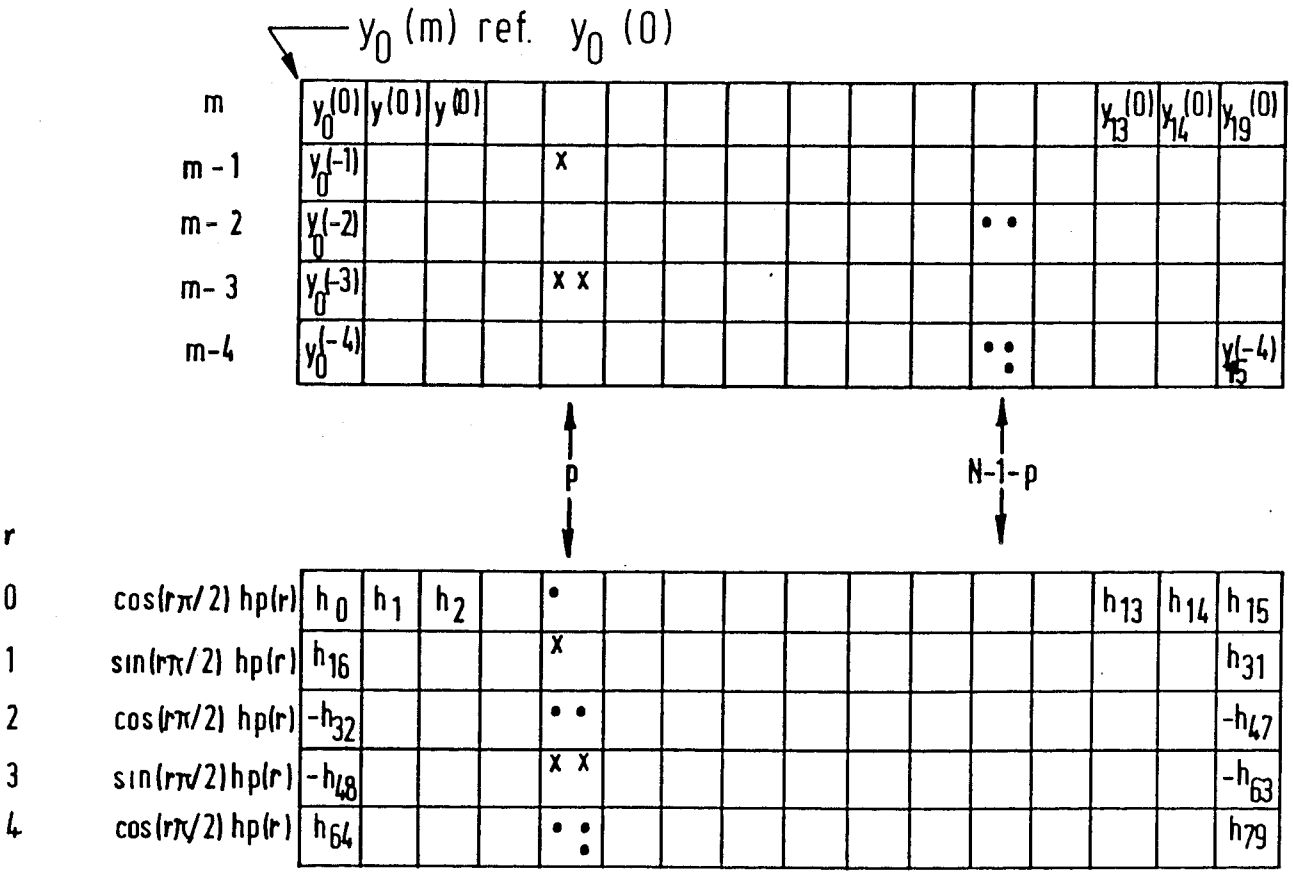

The tables of FIGS. 8 and 9 elucidate the filtering operations to be effected in the analyzing and synthesizing programs, respectively.

DETAILED DESCRIPTION OF THE INVENTION

Figure 1:
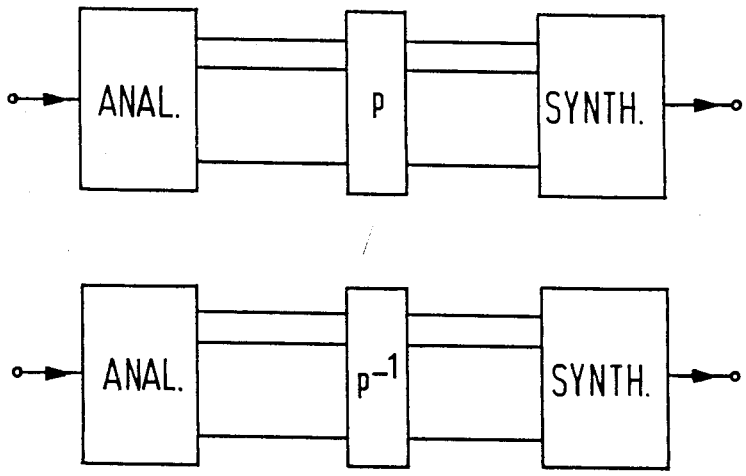
FIG. 1 shows a schematic diagram of the scramblingunscrambling system.

When using filters which realize a division into sub-bands and a substantially complete recovery, a scrambling-unscrambling system according to the following principle can be effected (FIG. 1):

signal analysis
permutation P of the sub-band signals
obtaining the scrambled signal by synthesis
analysis of the scrambled signal
inverse $P^{-1}$ permutation of the sub-band signals
obtaining the unscrambled signals by synthesis.

The reliability of the scrambling obtained by such a system is based on the strategy adopted for effecting the permutations. In the fixed-permutation systems, the choice is made such that the residual intelligibility is lowest possible. Unfortunately, this parameter largely depends on the speaker and, in addition thereto, utilizing the system is relatively simple if we assume that a chosen message and the associated cryptogram can be compared.

These inconveniences can be partly eliminated if the permutations, instead of being fixed, vary in time. Operating the key producing the permutations becomes complicated the moment the changing rate becomes higher. The residual intelligibility can even be very low and become completely independent of the speaker. On the other hand, there is the need of synchronization at the unscrambler.

Figure 2:
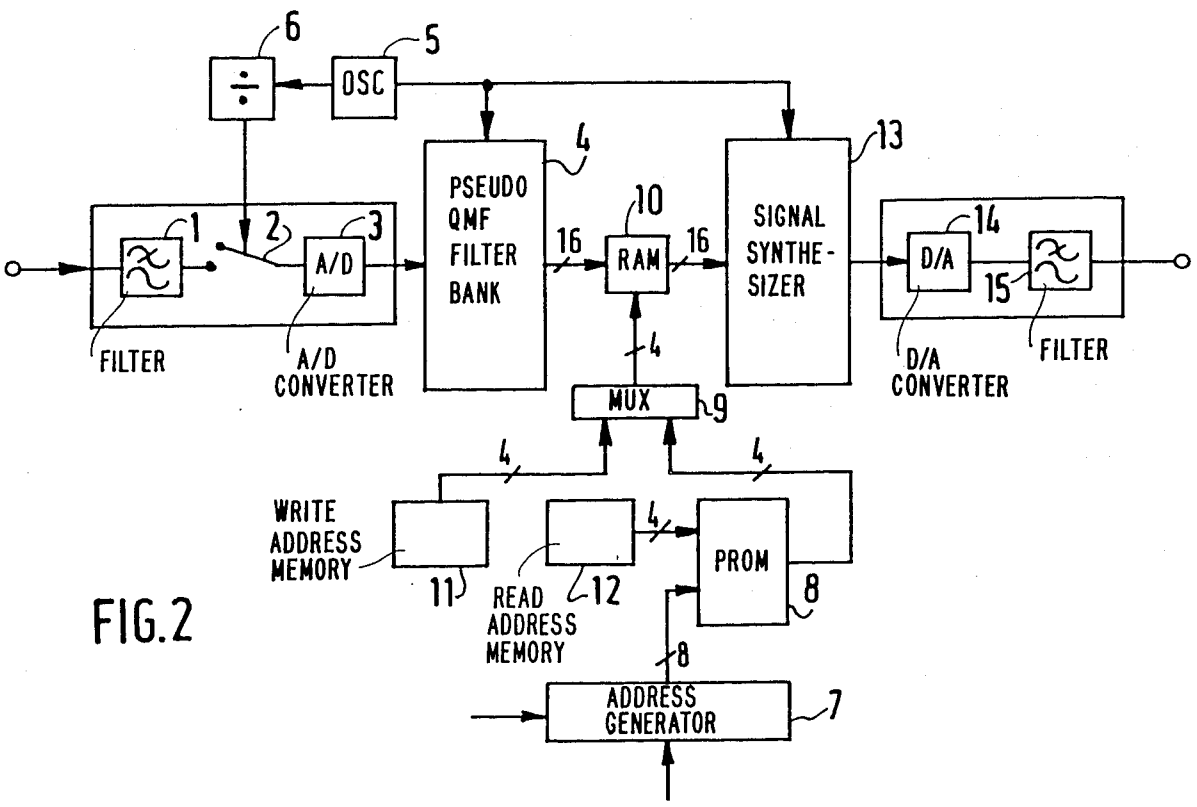
FIG. 2 shows the block diagram of the scrambler in accordance with the invention.
Figure 3:
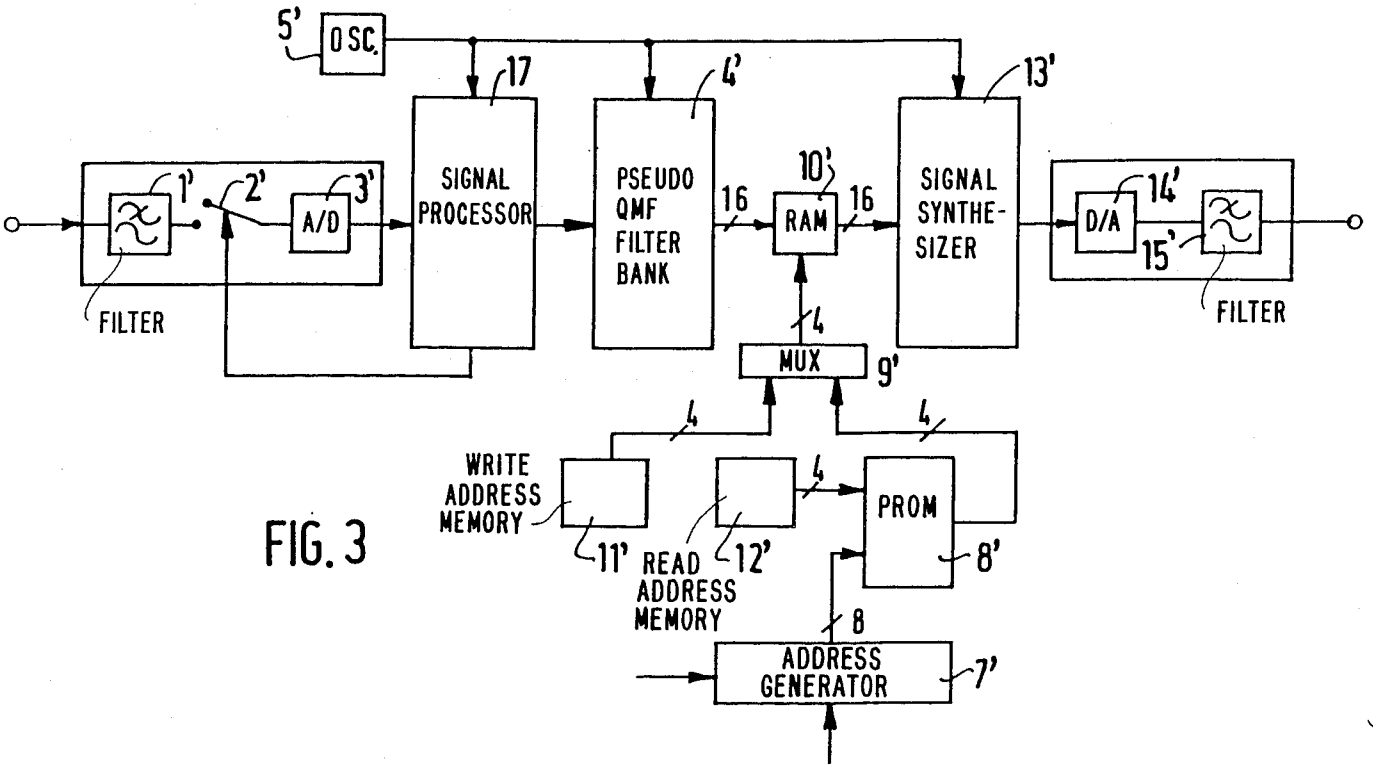
FIG. 3 shows the block diagram of the unscrambler according to the invention.

The block diagram of a scrambling-unscrambling system by means of dynamic band permutation is accordance with the invention is shown in FIGS. 2 and 3. In this arrangement the calculations required for the different processes are effected by digital signal processors such as the TMS 32010 manufactured by Texas Instruments.

For the analogue-to-digital converters and the digital-to-analogue converters as well as the filters, the COFIDEC TP3057 circuits manufactured by National Semiconductor (A-law-8 bit-conversion) are used. They offer the advantage of having all these functions in a single 16-pin casing.

The scrambler (FIG. 2) comprises the following processing stages:

Anti-aliassing filtering in 1 of the original signal

Sampling in 2 and digitizing by an analogue-to-digital converter in 3.

Analysis in 4 by means of a pseudo-QMF filter bank of 16 sub-bands of the signal sampled at the rate $f_e$ supplied by the oscillator 5 followed by the frequency divider 6. The prototype filter having 80 coefficients and the sub-band signals are sampled at $f_e/16$.

Permutation in 7 to 12 of the sub-band signals at the rate of $f_e/16$ (only 12 signals are permuted, the remaining 4 are not transmitted.

Synthesis in 13 of the permuted sub-band signals

Restoring the scrambled analogue signal by means of a digital-to-analogue converter 14 and a smoothing filter 15.

Digital addition of a frequency synchronizing wave $f_e/4$.

The speech signal coming from a microphone is applied to the input of the analogue-to-digital encoder (COFIDEC circuit) after the level is adapted. The signal is filtered prior to sampling at the rate of $f_e=7$ kHz, and is then converted into 8 bits PCM according to A-law. Subsequently, the sample is transferred in the processor in which, after linearization, the processing by the analysis filter bank takes place. This transforms the signal originally sampled at the rate $f_e$ into N sub-band signals sampled at $f_e/N$ (here N=16). The operations take place in the following order:

the processor reads a sample;

the contribution of this sample to the 16 sub-band signals is calculated;

one sample is supplied for each of the 16 sub-band signals during all 16 sampling cycles (of the duration T).

During this particular cycle in which the final calculation of the sub-band samples is effected, the 16 results are written into an external RAM 10. Subsequently, these samples are immediately transferred in the processor accomplishing the synthesisis filter bank but in a permuted order. The permutation utilizes the read addresses of the RAM. A set of 256 permutations is safeguarded in a PROM 8. Thus the choice of the permutation to be effected is represented by a word of 8 bits. A scrambling by means of dynamic permutation in time is obtained by changing the read addresses of the PROM. These 8 address bits come from a generator 7 of a sequence PN having a maximum length $2^n$-1 constituted by 16 flip-flops. The external RAM 10 addresses are written (E) or read (L) through the multiplexer 9 by the permutation from the PROM. The multiplexer (mux) 9 and the PROM 8 receive from 11 and 12, respectively, the write and read addresses.

The clock rate realizing the shift in the order is the permutation rate. This can vary from 0 (fixed permutation) to $f_e/N$ which is the maximum rate in fact, $f_e/N$ is the sampling rate of the sub-band signals and thus, two consecutive samples of a sub-band signal will be permuted in a different manner.

The samples of the permuted sub-band signals are then read by the synthesis processor. The latter, in a way similar to the processes effected during the analysis, forms 16 samples of the scrambled signal sampled at the rate of $f_e$ from 16 permuted sub-band samples which have been sampled at the rate of $f_e/N$. This scrambled signal is increased by the digital synchronizing wave $\sin(2\pi nTf_e/4)$. In order to prevent this signal, whose maximum level is situated at −18 dB of the saturation level of the decoder, from being disturbed too much by the speech signal, the sub-bands 13 and 14 are set around $f_e/4$, whereas these sub-bands were previously set at zero. The sub-bands 15 and 16 of the original signal are not transmitted either.

After compression MIC, the digital signal obtained in the above manner is transferred within the COFIDEC where it is converted into an analogue signal and then filtered. Subsequently, the analogue signal is transmitted and then processed by the unscrambler.

The following processes take place in the unscrambler (FIG. 3):

Anti-aliassing filtering in 1' of the scrambled signal

Synchronization of the sampling in 2' effected by a fully digital phase-locked loop and compensation of the synchronizing wave Digitizing by an analogue-to-digital converter 3'

Synchronization of the blocks and permutations, and calculation of the equalizing coefficients, during the initializing sequence Equalization of the scrambled signal with the aid of a transverse filter. The processes of synchronization and equalization are realized in the signal processor 17.

Analysis of the scrambled signal in 4'

Inverse permutation in the 7' to 12' of the sub-band signals

Synthesis in 13' of the sub-band signals returned to their position

Recovery of the unscrambled analogue signal with the aid of a digital-to-analogue converter 14' and a smoothing filter 15'.

For the essential part of the system the above processes are identical with those accomplished in the scrambler, the difference being that the permutations of the sub-band signals are inverted to those accomplished in the scrambler.

The scrambled speech signal is applied to the analogue input of the COFIDEC of the unscrambler and is filtered prior to being sampled. The sampling is controlled by the processor 17. The loop blocks onto the synchronizing wave at $f_e/4$ where $f_e$ is the sampling rate of the scrambler. Subsequently, the following operations are carried out consecutively: a compensation of the synchronizing wave (neutralization), a filtering of the signal by the equalizer whose coefficients have been obtained during the initial sequence with the aid of an adaptable equalizing program. The signal, equalized one time, is transferred to the processor which carries out the analysis, and the next process is equivalent to the one explained in the description of the operation of the scrambler. The PROM 8' for the permutations contains the inverse permutations of those accomplished in the scrambler. Its read addresses come from a generator 7' having a sequence PN of 16 flip-flops. The external RAM 10' inserted between the analysis processor and the synthesis processor has a write address E or a read address L through multiplexer (MUX) 9' by the inverse permutation output of the PROM. The multiplexer 9' and the PROM 8' receive from 11' and 12', respectively, the write and read addresses.

For a perfect unscrambling of the signal, the sub-band signals, after analysis of the scrambled signal, have to be identical with the signals applied to the synthesis bank of the scrambler. Therefore, the following has to be effected:

a synchronization of the sampling at the rate $f_e$ of the scrambled signal an equalization of the channel both with respect to the amplitude and the time of group propagation a synchronization of the blocks allowing to transmit the information of the sub-sampling phase accomplished in the analysis filter bank.

a synchronization of permutations

These different items will now be further analysed.

As regards the synchronization of the sampling, subjective tests of the quality of the restored speech signal have shown that sampling-phase deviations of 5% of the period T can be tolerated.

Figure 4:
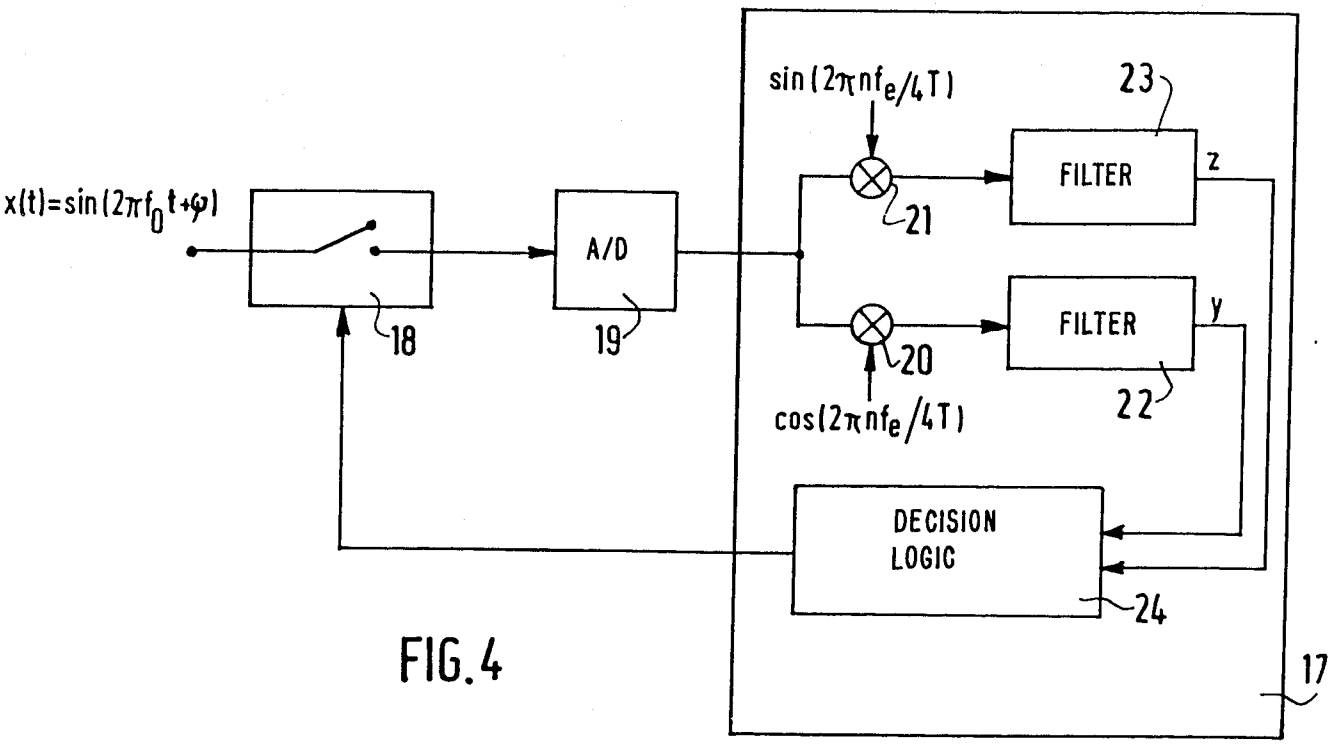
FIG. 4 shows the schematic diagram of a fully digital phase-locked loop.

For attaining this object, a fully digital phaselocked loop realized by means of a signal processor has been examined. This loop whose schematic diagram is shown in FIG. 4, comprises the following constituent elements:

a sampler-blocker 18 and an analogue-to-digital converter two quadrature demodulators (cosine and sine) 20 and 21 and their associated filters 22 and 23 a decision logic allowing to make the sampling-phase correction 24. Within the context of a signal processor 8 this correction is effected around the value of the free rate ($f_e$) by adding or subtracting a certain number of "machine cycles", which permits locking at double the loop rate.

The fully digital loop realized thus has the following principal characteristic features:

a rapid acquisition (about a hundred sampling periods)

a correct follow-up when interference occurs (noise-drift)

a simple realization by means of the signal processor.

Now we have the means which allow us to recover the sampling phase of the scrambled signal when, before transmission and digitally, we add the sequence thereto.

To compensate for the amplitude distortions and group propagationtime supplied through the channel, a filtering of the scrambled signal by an equalizer is required.

The function of an equalizer is to realize the inverse filter of the channel; if we denote the impulse responses of the channel and the equalizer h and g, we must have in the ideal case:

$$(h \otimes g)(n)=\delta(n-n_O)$$

in which $n_O$ represents the delay which the signal undergoes during a transmission in the channel after the equalizer. The equalizer is realized with the aid of a transverse filter having 48 coefficients.

Figure 6:
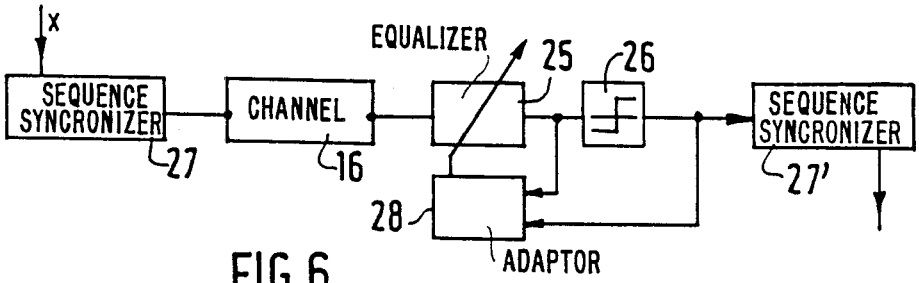
FIGS. 6 and 7 show the principle of the low-rate synchronization with the equalization operating blind and with a local reference, respectively.
Figure 7:
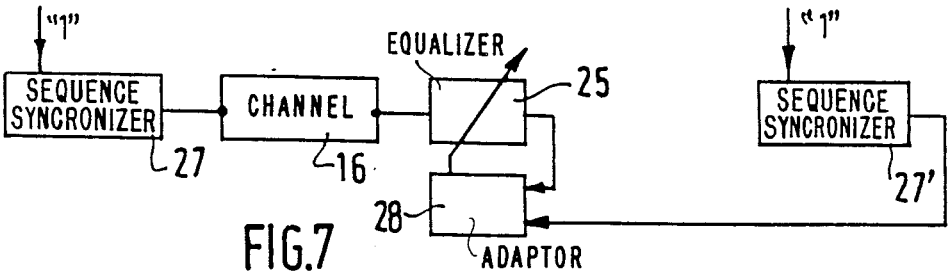

During the initializing sequence, an adaptive equalizing program on the signal processor allows finding the coefficients of the equalizing filter by means of the gradient algorithm. The adaptive equalizer first operates blind (FIG. 6) and then with a local reference (FIG. 7). For operating in this second manner, the characteristic feature of self-synchronization (FIG. 5) of the sequences PN is made use of. This feature is also used for transmitting the block synchronizations and for the permutations.

Figure 5:
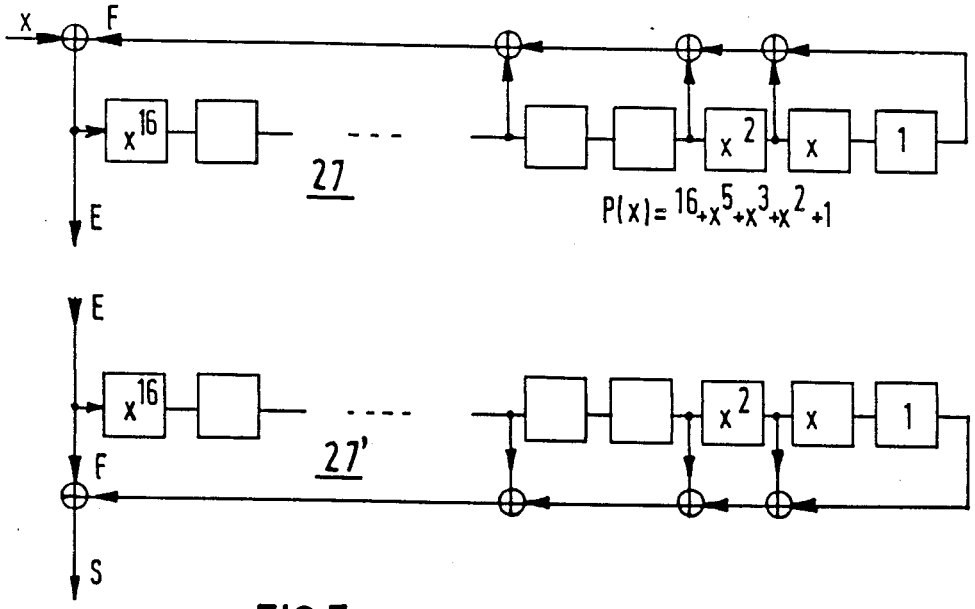
FIG. 5 shows the self-synchronization of a PN sequence.

FIG. 5 explains this characteristic feature of self-synchronization for a sequence PN 27 or 27', produced by the polynomial $P(x)=x\ 16+5+x3+x2+1$. The output E of the transmit circuit is obtained by adding modulo-2 x, the message to be transmitted, and F, the feedback signal, If E is applied to the input of the receive circuit, after 16 clock pulses (corresponding to the maximum degree of the generating polynomial) the output S is equal to x. Actually, whatever the initial state may be, 16 clock pulses will suffice because the flip-flops of the same order of ranking contain the same date. As $E=x+F$, the following can be calculated:

$$S=E\oplus F=(x\oplus F)+F\ldots=x\oplus(F\oplus F)=x\oplus 0=x.$$

If the output E of the transmit circuit (FIG. 5) is taken as a psuedo-random sequence for adaptive equalization, and if the equalizer operates blind as stated before (FIG. 6), it is attempted to synchronize the receive circuit when the signal denoted E' occurs, the result of the decision made when the equalized signal occurs. The imposed message x is a sequence of "1"; if the equalizer 25 looped through adaptor 28 has converged "sufficiently", that is to say the 32 successive bits have the correct value, the output S will assume 16 times the value "1". It can be estimated when the two sequences 27 and 27' are synchronized and the equalization can then operate with a local reference (FIG. 7). At that moment the receive circuit is switched to the local transmission permitting an optimal calculation for adapting the coefficient. Actually, when there is noise, decision errors may arise when the equalizer operates blind.

When the equalizer 25 operates with a local reference, permutation and block synchronizations are possible by recognizing a particular position of the flip-flops of registers PN.

Summarizing it can be observed that the processes effected by the processor (17) during the initializing sequence in the unscrambler are the following in the order stated below:

detection of the tone having the frequency $f_e/4$ indicating the beginning of the communication and locking onto a locked loop permitting sampling synchronization.

blind adaptive equalization switching to adaptive equalization with a local reference freezing of the adaptation of the coefficients and transfer to block synchronization and permutation synchronization which terminates the initializating sequence.

The processes effected by the processor (17) when operating "normal" (without an initializing sequence) are the following:

phase-locked loop compensation of the synchronizing wave equalization of the signal.

Below we will find several brief indications concerning the processing programs located in the processors.

ANALYSIS PROGRAM

The filter bank to be realized is composed of 16 filters have 80 coefficients each. If the filters are obtained by modulating a same filter prototype, this can be done in a very effective way. It is shown that in this case the filtering and modulating operations can be separated. The processes are effected in the following manner: Let use assume that Xk(m) is the $k^{th}$ sub-band signal ($k=0, \ldots, N-1$) sampled at a rate $f_e/N$. On the basis of output signals filtering elements denoted p(m) can be obtained from:

$$Xk(m)=\sum_{\rho=0}^{N-1} p\rho(m)\cdot c(k\cdot\rho)$$

where $c(k,\rho)=2\cos((2k+1)\ (2\rho+1)\ (2\rho+1)\pi/4N)$ is the middle of the odd cosine transform.

The tables of FIG. 8 show the filtering operations to be realized for obtaining the signals $p\rho(m)$.

Formally, $p\rho$ (m) can be written as:

$$p\rho(m) = -\sum_{r=0}^{\lambda-1}\cos(r\pi/2)\cdot h\rho(r)\cdot X\rho(m-r) - \sum_{r=0}^{\lambda-1}\sin(r\pi/2)\cdot h\rho(r)\cdot X_{N-1-\rho}(m-\lambda+r+1)$$

where $h\mu(r)=h(rN+\rho)$, in which h is the impulse response of the prototype filter, $x\rho(m)=x(mN-\rho)$, in which x is the input signal, $\lambda=Nc/N$, in which Nc is the number of coefficients of the prototype filter. In the present case, Nc=80 coefficients, N=16 and thus $\lambda=5$.

The upper table of the Fib. 8 shows the memory of the 80 most recent signal samples, arranged in 5 lines of 16 elements. The most recent sample is shown in the left hand top corner while the oldest sample is shown in the right hand bottom corner. The bottom table shows the memory of the 80 prototype filter coefficients likewise arranged in 5 lines of 16 elements and bearing the signs of the numbers of $\cos(r\pi/2)$ and $\sin(r\pi/2)$ appearing in the formula shown hereinafter.

The value of $p\rho$ (m) is obtained by calculating the sum of the 5 products whose factors are visualized by the same sign in each table. It is clear that for calculating $p\rho$ (m) it is not necessary to know the complete table and that it can be effected as soon as $x\rho$ (m) has arrived. For calculating Xk(m) it is necessary to know all the signals $p\rho$ (m). Nevertheless, the partial products $p\rho$ (m), $C(k,\rho)$ can be calculated after each calculation of $p\rho$ (m), by means of $k=0, \ldots, N-1$, that is to say the contribution of $p\rho$ (m) to the calculation of each of the sub-band signals.

SYNTHESIS PROGRAM

The processes effected in the synthesis filter bank are the same as those effected in the analysis filter bank. The permuted sub-band signals are first modulated by the odd cosine transform according to the following formula:

$$y(m) = -N \sum_{k=0}^{N-1} c(k, \rho) \cdot Xs(k)(m)$$

where s is the permutation.

The signals $y\rho$ (m) are then filtered for obtaining the scrambled signals in the manner indicated in the two tables of FIG. 9.

$$\overset{(b)}{X\rho(m)} = -\sum_{r=0}^{\lambda-1} \sin(r\pi/2) \cdot h\rho(r) \cdot y\rho(m-r) + \sum_{r=0}^{\lambda-1} \cos(r\pi/2) \cdot h\rho(r) \cdot y_{N-1-\rho}(m-r)$$

What is claimed is:

1. Analogue scrambling system in which the processing of the speech signal accomplished in digital signal processors comprises the following operations: filtering (1), sampling (2) and digitizing in an analogue-to-digital converter (3), processing by an analysis filter bank (4) transforming the signal sampled at the rate $f_e$ into N subband signals sampled at $f_e/N$ and transferred in a permuted order to the synthesis filter bank (13) which carries out the calculations of the scrambled signal sampled at the rate $f_e$ to which is digitially added a synchronizing wave, whilst the scrambled digital signal obtained thus is converted into an analogue signal (14), filtered (15) and transmitted through an analogue channel to the unscrambler where a preprocessor effects in (17) the synchronizing of the sampling, the compensation of the said synchronizing wave and the equalizing of the scrambled signal and where the processes that have been accomplished are identical with those accomplished at the scrambler but for the fact that the said permuted order of N subband signals is reversed, characterized in that the said synchronizing wave bears a simple ratio to the sampling frequency and the said synchronizing functions of the sampling and compensation of the said synchronizing wave are accomplished digitally, scrambling by dynamic permutation in time is obtained by changing the read addresses of a memory (8) containing a number of permutations, these addresses coming from a pseudo random generator (7) whose clock rate providing the changing rate of the permutations can very between 0 (fixed permutation) and $f_e/N$ (maximum rate), while the key of the system is a speech signal which is loaded into the pseudo random generator during the initializing sequence.

2. A scrambling system as claimed in claim 1, characterized in that the sampling synchronization of the synchronizing wave is effected in the unscrambler by means of a fully digital phase-locked loop and at double the locking rate.

3. A scrambling system as claimed in claim 1, characterized in that the amplitude and phase distortions of the scrambled signal caused by the transmission channel are corrected by means of an equalizer.

4. A scrambling system as claimed in claim 2, characterized in that the same phase-locked loop is utilized for effecting sample synchronizing prior to the calculation of the equalizing coefficients with the aid of an adaptive equalizing algorithm operating in a blind equalizing mode and an equalizing mode with a local reference, respectively.

5. A scrambling system as claimed in claim 4, characterized in that the said equalizing coefficients are obtained by means of an adaptive equalizing algorithm operating in a blind equalizing mode and an equalizing

6. A scrambling system as claimed in claim 5, characterized in that the operation of the said adaptive equalizer with a local reference permits to synchronizing the permutations by recognizing a particular condition of the system producing the said local reference.

* * * * *